US007091663B2

(12) United States Patent
Yoshinari et al.

(10) Patent No.: US 7,091,663 B2
(45) Date of Patent: Aug. 15, 2006

(54) DISPLAY PANEL, METHOD OF MANUFACTURING THE DISPLAY PANEL, AND PARTITION WALL USED IN THE DISPLAY PANEL

(75) Inventors: Masaki Yoshinari, Yamanashi-ken (JP); Kazuya Akiyama, Yamanashi-ken (JP)

(73) Assignee: Pioneer Corporation, Tokyo (JP)

( * ) Notice: Subject to any disclaimer, the term of this patent is extended or adjusted under 35 U.S.C. 154(b) by 300 days.

(21) Appl. No.: 10/715,423

(22) Filed: Nov. 19, 2003

(65) Prior Publication Data

US 2004/0104666 A1 Jun. 3, 2004

(30) Foreign Application Priority Data

Nov. 28, 2002 (JP) ..... 2002-345727

(51) Int. Cl.
*H01J 17/49* (2006.01)
*H01J 9/40* (2006.01)

(52) U.S. Cl. ..... 313/582; 313/583; 313/585; 445/24; 445/25

(58) Field of Classification Search ..... 313/581–587
See application file for complete search history.

(56) References Cited

U.S. PATENT DOCUMENTS 3,683,222 A * 8/1972 Bernard ..... 313/585
3,776,613 A * 12/1973 Van Esdonk et al. ..... 445/24
3,801,852 A * 4/1974 Janning ..... 313/583
5,264,758 A * 11/1993 Iijima et al. ..... 313/584
5,371,437 A * 12/1994 Amano ..... 313/584
5,493,175 A * 2/1996 Kani ..... 313/584

FOREIGN PATENT DOCUMENTS

| | | | |
|---|---|---|---|
| EP | 0 448 727 A1 | | 10/1991 |
| JP | 55086041 A | * | 6/1980 |
| JP | 2004-100335 | | 4/2000 |
| JP | 2000-195431 | | 7/2000 |
| JP | 2000223035 A | * | 8/2000 |
| JP | 2003031126 A | * | 1/2003 |

* cited by examiner

*Primary Examiner*—Mariceli Santiago
(74) *Attorney, Agent, or Firm*—Arent Fox PLLC

(57) ABSTRACT

Two substrates are placed opposite each other to form a hermetically sealed space between them. A metal-made partition wall is placed between the two substrates to partition the hermetically sealed space into unit light emission areas. Through holes 20Aa are formed in a matrix arrangement in a portion 20A of the metallic partition wall 20 opposite a display area portion of the back glass substrate 4. Dummy through holes 20Ba are formed in a portion 20B of the partition wall 20 opposite a non-display area portion of the back glass substrate 4. An insulating layer 20*a* covers the outer surface of the partition wall 20.

6 Claims, 6 Drawing Sheets

SECTION V-V

SECTION W-W

SECTION W1-W1

DISPLAY PANEL, METHOD OF MANUFACTURING THE DISPLAY PANEL, AND PARTITION WALL USED IN THE DISPLAY PANEL

BACKGROUND OF THE INVENTION

1. Field of the Invention

This invention relates to a display panel having a hermetically sealed space formed between two substrates, a method of manufacturing the display panel, and a partition wall included in the display panel.

The present application claims priority from Japanese Application No. 2002-345727, the disclosure of which is incorporated herein by reference.

2. Description of the Related Art

Display panels used in display apparatuses include a flat display panel designed to have a hermetically sealed space formed between two substrates, such as a plasma display panel (hereinafter referred to as "PDP") and a field emission display panel (hereinafter referred to as "FED").

FIG. 1 is a schematic front view illustrating the cell structure of a conventional PDP. FIG. 2 is a sectional view taken along the V—V line in FIG. 1.

The conventional PDP includes a front glass substrate 1, serving as the display screen of the panel, having a back surface on which a plurality of row electrode pairs (X, Y), a dielectric layer 2 covering the row electrode pairs (X, Y), and an MgO-made protective layer 3 covering the back surface of the dielectric layer 2 are formed in this order.

Each of the row electrodes X (Y) includes transparent electrodes Xa (Ya) each formed of a wide transparent conductive film made of ITO (Indium Tin Oxide) or the like, and a bus electrode Xb (Yb) formed of a metal film of a small width assisting the conductivity of the transparent electrodes.

The row electrodes X and Y are arranged in alternate positions in the column direction such that the transparent electrodes Xa and Ya of the respective row electrodes X and Y face each other with a discharge gap g in between, and each of the row electrode pairs (X, Y) forms a display line L in matrix display.

The front glass substrate 1 is opposite a back glass substrate 4 with a discharge-gas-filled discharge space S in between. On the back glass substrate 4, a plurality of column electrodes D are regularly arranged and each extend in a direction at right angles to the row electrode pairs (X, Y); a column electrode protective layer 5 covers the column electrodes D; a partition wall 6 formed in a shape partitioning the discharge space as will be described later; and red-, green-, and blue-colored phosphor layers 7 individually formed in such a way as to cover the column electrode protective layer 5 and the side faces of the partition wall 6.

The partition wall 6 is formed in a grid shape of transverse walls 6A and vertical walls 6B. Each of the transverse walls 6A extends in a row direction in a position opposite the bus electrodes Xb and Yb which are arranged back to back in between the respective and adjacent row electrode pairs (X, Y). Each of the vertical walls 6B extends in a column direction in a position opposite a midpoint between the two adjacent transparent electrodes Xa and between the two adjacent transparent electrodes Ya, the transparent electrodes Xa and Ya being lined up at regular intervals along the corresponding bus electrodes Xb and Yb of the respective row electrodes Y and X. The partition wall 6 defines discharge cells C in each of which the two transparent electrodes Xa and Ya of the row electrode pair (X, Y) face each other with the discharge gap g in between.

The partition wall 6 partitioning the discharge space into the discharge cells C is conventionally formed of insulating materials. For example, a thick coat of a partition wall material such as a glass paste or the like is applied on the back glass substrate 4 and then dried. Then, the resulting insulating materials undergo a sandblasting process through the medium of a mask, trimmed into a predetermined pattern, to be cut into the grid shape, and then a burning process for completion.

Such the foregoing conventional method of forming a partition wall is showed in JP Pat. Publication No. 2000-195431.

However, the conventional method of forming the partition wall with use of the sandblasting process has the problems of a degradation in productivity and an increase in manufacturing costs because of such a complicated manufacturing process.

Therefore, instead of the conventional partition wall formed by patterning the insulating materials, the use of metal-made partition wall covered with an insulating layer is suggested.

FIG. 3 is a plan view illustrating the structure of such a metal-made partition wall, and FIG. 4 is a side view illustrating the metal-made partition wall mounted on a substrate.

In FIG. 3, a metallic partition wall 10 having the surface covered with an insulating layer includes a portion 10A situated in a position corresponding to the display area of the display panel. The portion 10A has a matrix arrangement of through holes 10Aa opened therein and each having a quadrangular opening.

The display area portion 10A is surrounded by a flat plate-shaped portion 10B situated in a position corresponding to the non-display area of the display panel.

As shown in FIG. 4, the metallic partition wall 10 is arranged on the column electrode protective layer 5, covering the column electrodes on the back glass substrate 4 (see FIG. 2), so as to place each of the through holes 10Aa into a position for defining the corresponding discharge cell C.

After that, a burning process is performed so that the insulating layer of the metallic partition wall 10 is fused to the column electrode protective layer 5 to secure the metallic partition wall 10 onto the back glass substrate 4.

At this point, however, the following problems are produced in the metallic partition wall 10 structured as illustrated in FIG. 3.

During the burning process for securing the metallic partition wall 10 to the back glass substrate 4, in the display area of the display panel, a binder (resin component) and the like evaporates from the column electrode protective layer 5 and then emanates from the through holes 10Aa of the metallic partition wall 10. However, the non-display area of the display panel has no escape route for the binder evaporating from the column electrode protective layer 5 and emanating from the non-display area portion 10B of the metallic partition 10 which is sited in the non-display area. As a result, after completion of the burning process, a difference in thickness is produced between the portion of the column electrode protective layer 5 corresponding to the display area of the display panel and the portion of the column electrode protective layer 5 corresponding to the non-display area.

Because of the this difference in thickness, thus, there may be occurrence of disjoining between the metallic partition wall 10 and the column electrode protective layer 5 in the boundary portion between the display area and the non-display area of the display panel.

SUMMARY OF THE INVENTION

The present invention has been made to solve the problems associated with the display panels using the metallic partition wall as described above.

Accordingly it is an object of the present invention to prevent the occurrence of disjoining between a metallic partition wall and a column electrode protective layer in the boundary portion between a display area and a non-display area of a display panel.

An aspect of the present invention provides a display panel. The display panel advantageously includes: first and second substrates placed opposite each other to form a hermetically sealed space between them; a resin layer formed on the first substrate; and a metal plate which is covered with an insulating layer, and is fixed onto an inner surface of the first substrate by the resin layer, and has a plurality of formed-for-unit-light-emission-area through holes formed in a matrix arrangement in a portion of the metal plate opposite a display area portion of the first substrate for formation of unit light emission areas, and burning-process-use through holes formed in a portion of the metal plate opposite a non-display area portion of the first substrate to function in a burning process.

In the manufacturing process for the display panel according to the first aspect, the metal plate having the formed-for-unit-light-emission-areas through holes and the burning-process-use through holes is arranged in a predetermined position on the first substrate having the resin layer formed on its inner surface.

After that, the burning-process is performed. Hence, the resin layer formed on the first substrate is fused to the insulating layer covering the metal plate, so that the metal plate is fixed to the predetermined position on the substrate concerned.

During the burning process, in the display area portion of the first substrate opposite the portion of the metal plate in which the formed-for-unit-light-emission-area through holes are formed, a resin component evaporating from the resin layer formed on the first substrate emanates from the formed-for-unit-light-emission-area through holes. Further, in the non-display area portion of the first substrate opposite the portion of the metal plate in which the burning-process-use through holes are formed, the resin component evaporating from the resin layer emanates also from the burning-process-use through holes.

Due to this design, in the display panel after the manufacturing process, the resin layer formed on the first substrate of the display panel has approximately equal thickness in the display area portion and the non-display area portion, and therefore has a negligible gap produced in the boundary portion between the display area portion and the non-display area portion.

As a result, with the display panel according to the first aspect of the present invention, it is possible to prevent the metal plate, constituting a partition wall for defining the unit light emission areas, from coming off from the substrate after completion of the manufacturing process.

A second aspect of the present invention provides a method of manufacturing display panels. The method advantageously includes the steps of: forming a resin layer on an inner surface of a first substrate of first and second substrates which will be placed opposite each other to form a hermetically sealed space between them; arranging, on the resin layer formed on the first substrate, a metal plate covered with an insulating layer and having a plurality of formed-for-unit-light-emission-area through holes formed in a matrix arrangement in a portion opposite a display area portion of the first substrate for formation of unit light emission areas, and burning-process-use through holes formed in a portion opposite a non-display area portion of the first substrate to function in a burning process; and burning the first substrate, having the metal plate arranged thereon, to fix the metal plate onto the first substrate by the resin layer.

In the method of manufacturing the display panel according to the second aspect, the resin layer is formed on the inner surface of the first substrate, and then the metal plate with the formed-for-unit-light-emission-areas through holes and the burning-process-use through holes is placed in a predetermined position on the first substrate with the resin layer.

After that, the burning process is performed. Hence, the resin layer formed on the first substrate is fused to the insulating layer covering the metal plate, so that the metal plate is fixed to the predetermined position on the first substrate.

During the burning process, in the display area portion of the first substrate opposite the portion of the metal plate in which the formed-for-unit-light-emission-area through holes are formed, a resin component evaporating from the resin layer formed on the first substrate emanates from the formed-for-unit-light-emission-area through holes. Further, in the non-display area portion of the first substrate opposite the portion of the metal plate in which the burning-process-use through holes are formed, the resin component evaporating from the resin layer emanates from the burning-process-use through holes.

For this reason, the display panel manufactured by the method of manufacturing the display panels according to the present invention has the resin layer formed on the first substrate and having approximately equal thickness in the display area portion and the non-display area portion. Therefore the display panel has a negligible gap produced in the boundary portion between the display area portion and the non-display area portion of the resin layer.

As a result, the display panel manufactured by the method according to the present invention is capable of preventing the metal plate, constituting a partition wall for defining the unit light emission areas, from coming off from the substrate after completion of the manufacturing process.

A third aspect of the present invention provides a display-panel-use partition wall made of metal and placed between first and second substrates, arranged opposite each other with a hermetically sealed space in between, to partition the hermetically sealed space in to unit light emission areas. The display-panel-use partition wall advantageously includes formed-for-unit-light-emission-area through holes which are formed in a matrix arrangement in a portion of a metal plate opposite a display area portion of the first substrate for formation of the unit light emission areas, and burning-process-use through holes which are formed in a portion of the metal plate opposite a non-display area portion of the first substrate to function in a burning process, and has an outer surface entirely covered with an insulating layer.

In the manufacturing process for the display panel, the display-panel-use partition wall according to the third aspect of the present invention is arranged in a predetermined position on the substrate having the resin layer formed on its inner surface.

After that, the burning process is performed. Hence, the resin layer formed on the first substrate is fused to the insulating layer covering the display-panel-use partition wall, so that the display-panel-use partition wall is fixed to the predetermined position on the first substrate.

During the burning process, in the display area portion of the first substrate opposite the portion of the display-panel-use partition wall in which the formed-for-unit-light-emission-area through holes are formed, a resin component evaporating from the resin layer fused with the display-panel-use partition wall emanates from the formed-for-unit-light-emission-area through holes. Further, in the non-display area portion of the first substrate opposite the portion of the display-panel-use partition wall in which the burning-process-use through holes are formed, the resin component evaporating from the resin layer emanates from the burning-process-use through holes.

Accordingly, in the display panel using the display-panel-use partition wall after the manufacturing process, the resin layer formed on the substrate of the display panel has approximately equal thickness in the display area portion and the non-display area portion, and therefore has a negligible gap produced in the boundary portion between the display area portion and the non-display area portion.

As a result, once the display-panel-use partition wall according to the present invention is fixed to the display panel, the display-panel-use partition wall may be retained without coming off from the substrate of the display panel.

These and other objects and features of the present invention will become more apparent from the following detailed description with reference to the accompanying drawings.

DETAILED DESCRIPTION OF THE PREFERRED EMBODIMENTS

Preferred embodiments according to the present invention will be described hereinafter in detail with reference to the accompanying drawings.

Figure 5:
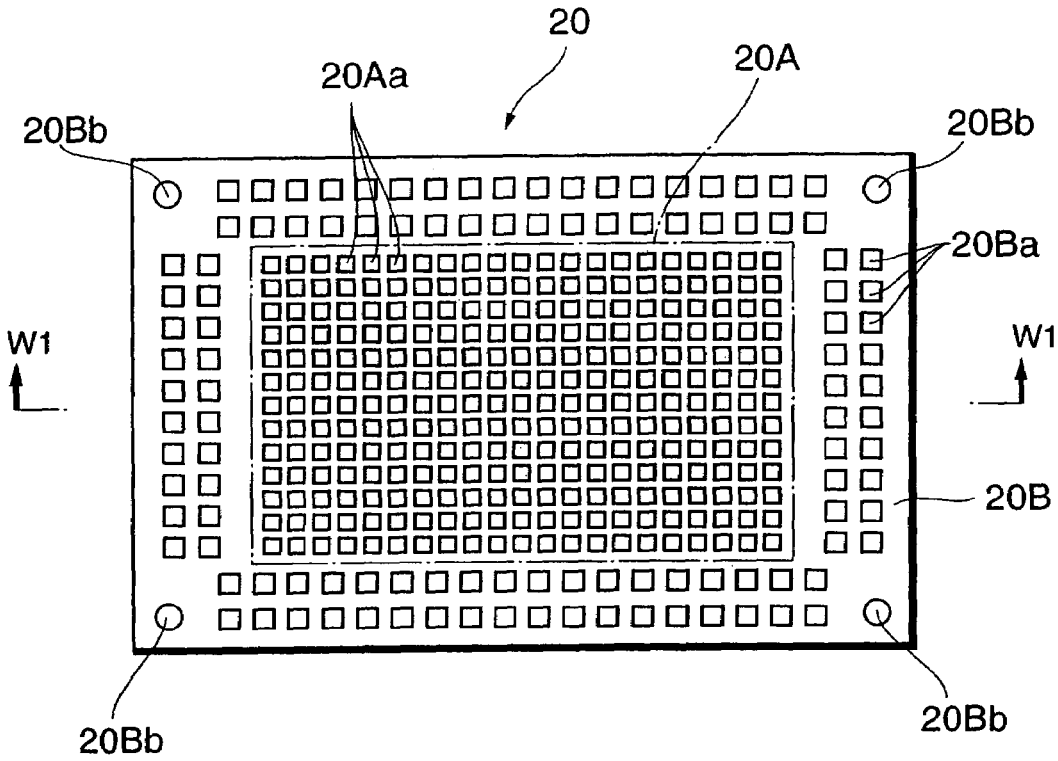
FIG. 5 is a plan view illustrating an embodiment of a partition wall used in a display panel in accordance with the present invention.
Figure 6:
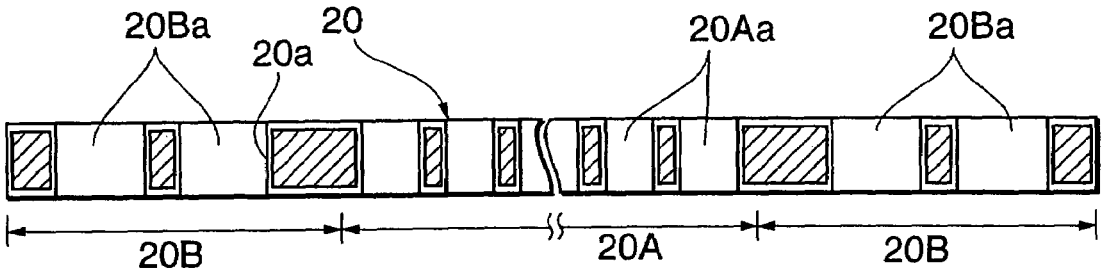
FIG. 6 is a sectional view taken along the W1—W1 line in FIG. 5.

FIG. 5 is a plan view illustrating an embodiment of the display panel according to the present invention. FIG. 6 a sectional view taken along the W1—W1 line in the display panel FIG. 5.

Figure 1:
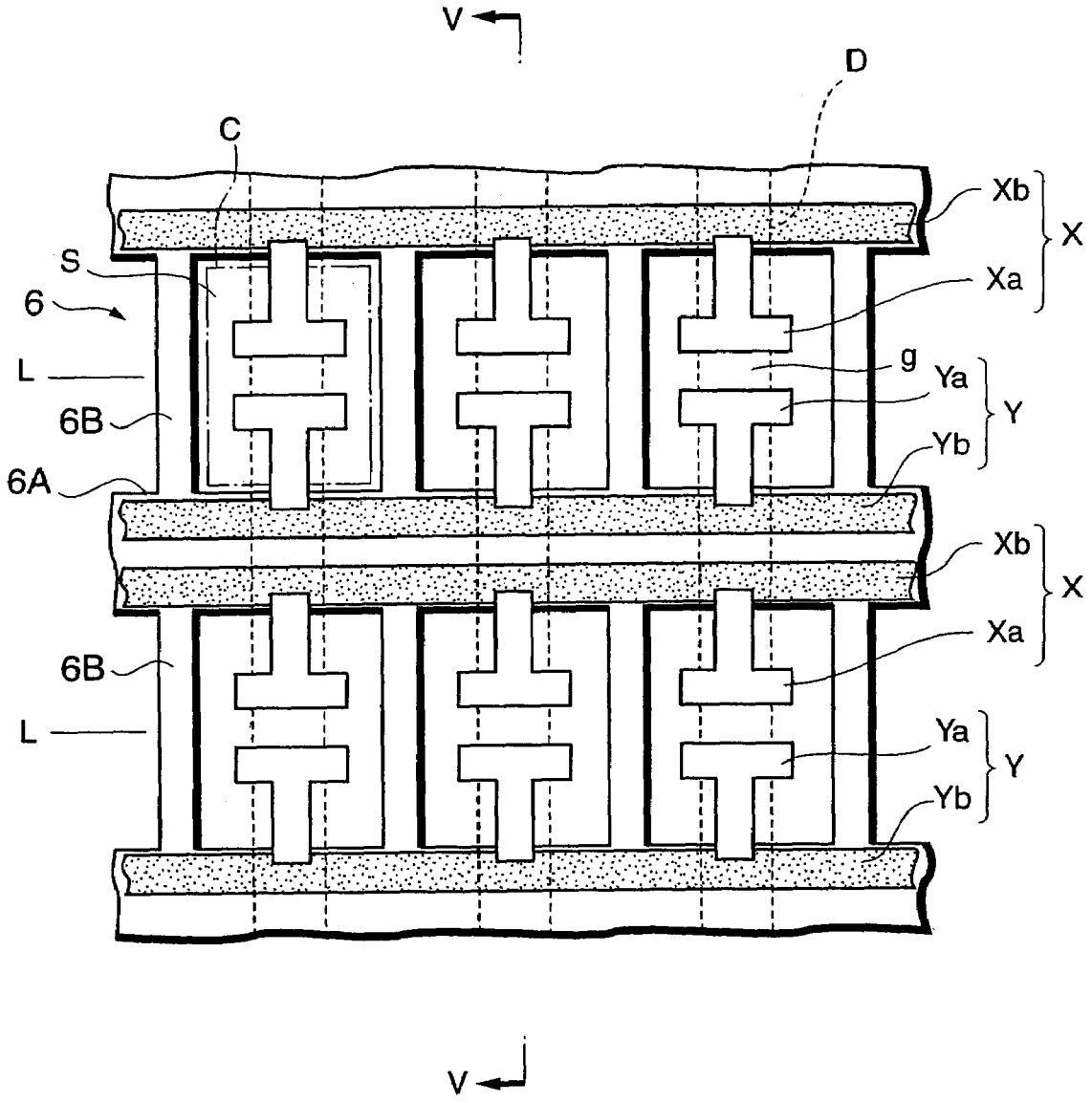
Fig. 1 PRIOR ART
FIG. 1 is a front view illustrating the structure of a conventional plasma display panel.
Figure 2:
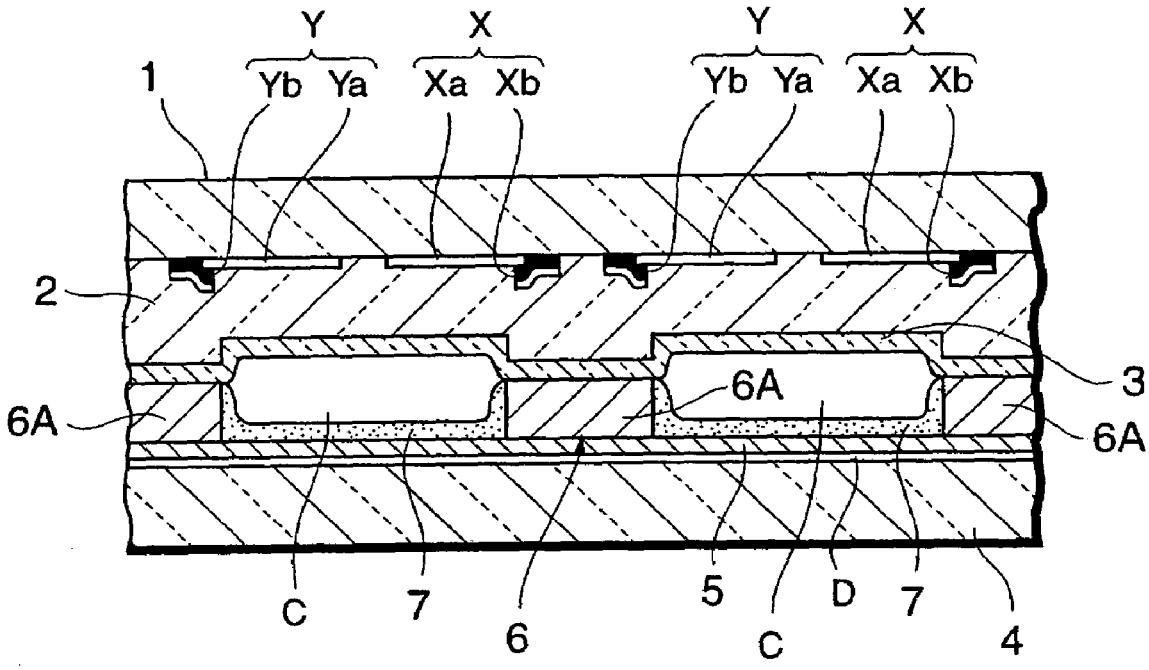
Fig.2 PRIOR ART
FIG. 2 is a sectional view taken along the V—V line in FIG. 1.
Figure 3:
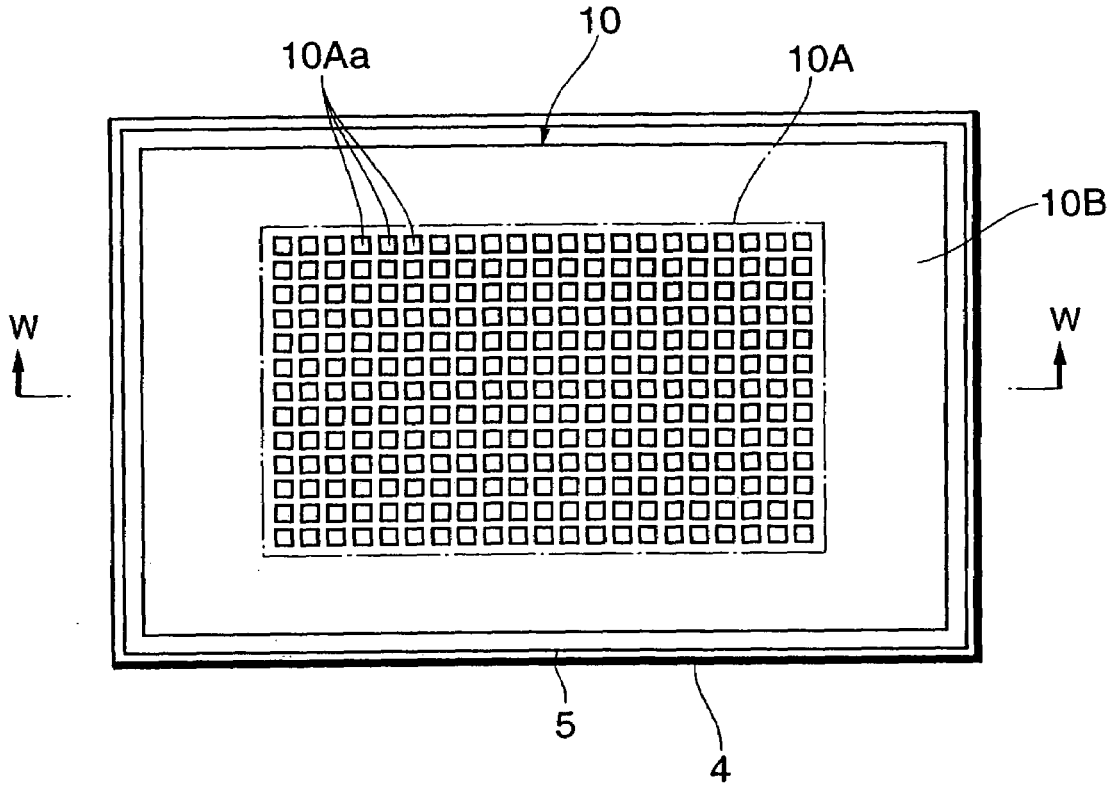
Fig.3 PRIOR ART
FIG. 3 is a plan view illustrating the structure of a conventional metallic partition wall.
Figure 4:
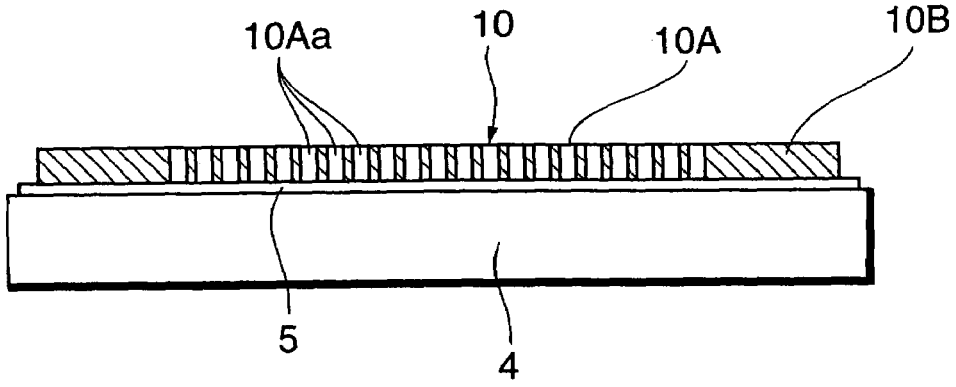
Fig.4 PRIOR ART
FIG. 4 is a sectional view taken along the W—W line in FIG. 3.

In FIGS. 5 and 6, as in the case of the metallic partition wall 10 described in FIG. 3, a metallic partition wall 20 has a portion 20A located in the display area of the display panel. The portion 20A has a matrix arrangement of through holes 20Aa formed therein and each having a quadrangular-shaped opening.

A flat plate-shaped portion 20B located in the non-display area of the display panel is formed all around the display area portion 20A. A plurality of dummy through holes 20Ba is formed in the non-display area portion 20B.

In the embodiment, the dummy through hole 20Ba has a quadrangle shaped opening larger in size than that of the through hole 20Aa. The dummy through holes 20Ba are arranged at regular intervals in two rows in line with the display area portion 20A in each of the four side-margins of the non-display area portion 20B around the display area portion 20A of the metallic partition wall 20.

A registration through hole 20Bb is formed in each of the four corners of the non-display area portion 20B of the metallic partition wall 20.

As shown in FIG. 6, the entire surface of the metallic partition wall 20 is covered with an insulating layer 20*a*.

Next, a description will be given of a manufacturing process for mounting the metallic partition wall 20 on the back glass substrate for the manufacture of the display panel.

The following description takes as an example the manufacturing process for PDPs representative of the display panel. However, the metallic partition wall 20 according to the present invention is applicable to other flat display panels such as the FED and the like, and in this case, the manufacturing process is approximately the same as that for the PDP.

Figure 7:
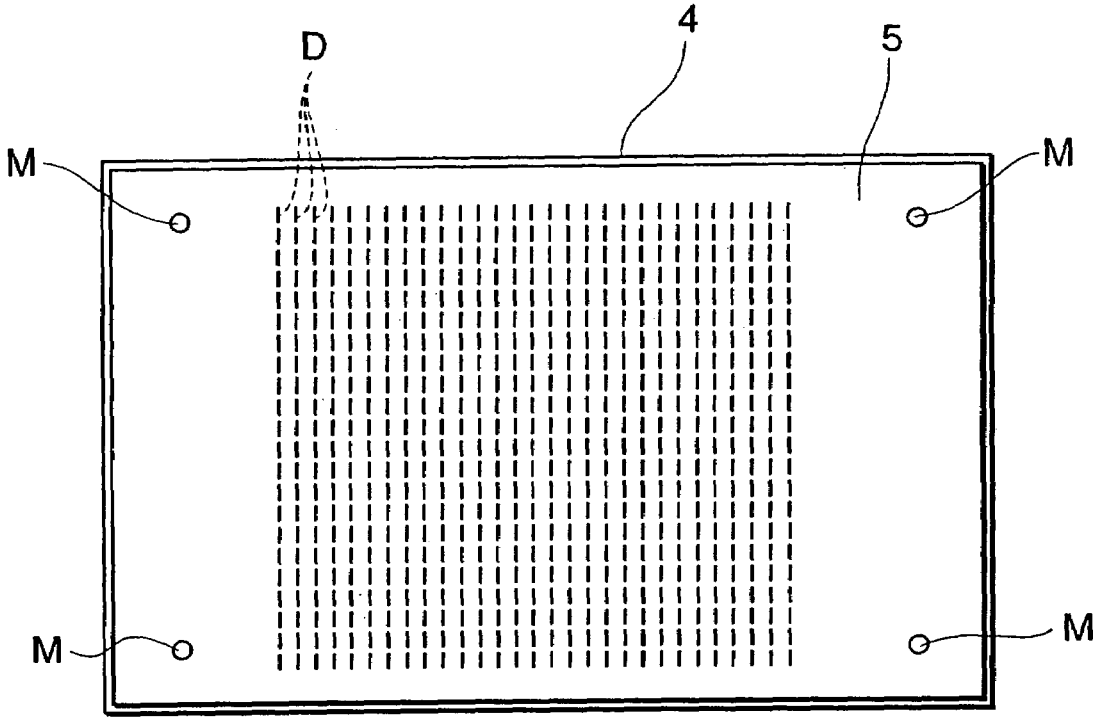
FIG. 7 is a plan view illustrating the structure of a back glass substrate of the plasma display panel.
Figure 8:
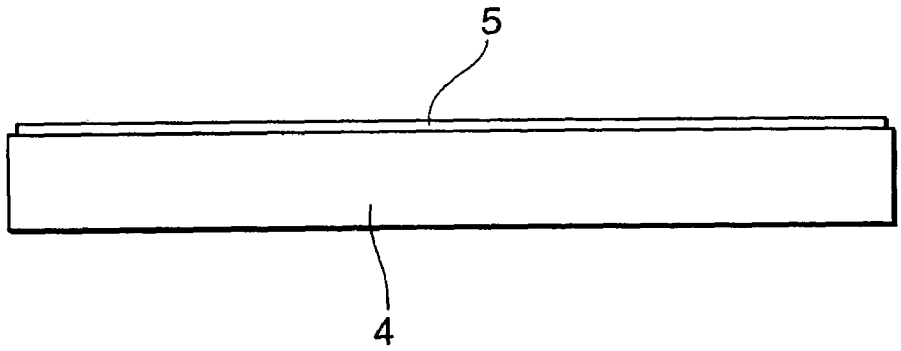
FIG. 8 is a side view of the back glass substrate in FIG. 7.

FIG. 7 is a plan view illustrating the structure of the back glass substrate of the PDP, and FIG. 8 is a sectional view of FIG. 7.

In FIGS. 7 and 8, on the inner surface of the back glass substrate 4 (the upward surface in FIG. 8), column electrodes D each extending in a column direction (the up-down direction in FIG. 7) are arranged at regular intervals in a row direction (the right-left direction in FIG. 7).

The column electrodes D are covered with the column electrode protective layer 5 formed on the back glass substrate 4.

As will be described later, registration marks M are formed respectively in the four corners of the inner surface of the back glass substrate 4 in a one-to-one correspondence with the registration through holes 20Bb of the metallic partition wall 20.

Figure 9:
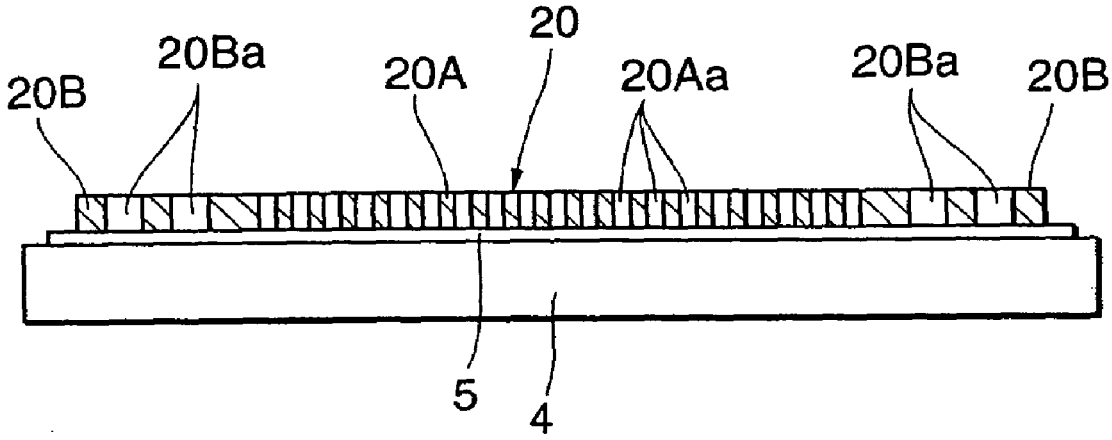
FIG. 9 is a sectional side view illustrating the display-panel-use partition wall, shown in FIG. 5, mounted on the back glass substrate.

In the manufacturing process, as illustrated in FIG. 9, the metallic partition wall 20 is arranged on the back glass substrate 4 after the column electrodes D, the column electrode protective layer 5 and the registration marks M are formed as described earlier.

At this point, the metallic partition wall 20 is positionally adjusted with respect to the back glass substrate 4 such that the four registration through holes 20Bb formed in the four corners of the metallic partition wall 20 are respectively aligned with the four registration marks M formed in the four corners of the back glass substrate 4. Due to this positional adjustment, each of the through holes 20Aa of the metallic partition wall 20 is positioned to be in alignment with each intersection position between the column electrode D on the back glass substrate 4 and a row electrode pair formed on a front glass substrate when the back glass substrate 4 is joined on the front glass substrate in a later process.

After completion of the positional adjustment, a burning process is performed so that the column electrode protective layer 5 and the insulating layer 20*a* of the metallic partition wall 20 are fused to each other to fix the metallic partition wall 20 in the predetermined position on the back glass substrate 4.

At this point, in the display area portion 20A of the metallic partition wall 20, a binder (resin component) evaporating from the column electrode protective layer 5 during the burning process emanates from the through holes 20Aa formed in the display area portion 20A. And also in the non-display area portion 20B, the binder (resin component) evaporating from the column electrode protective layer 5 emanates from the dummy through holes 20Ba formed in the non-display area portion 20B.

For this reason, the display panel produced using the metallic partition wall 20 has the column electrode protective layer 5 of approximately equal thickness in the display area portion and the non-display area portion, which thus has a negligible chance of a gap occurring in the boundary portion between the display area portion and the non-display area portion.

As a result, the display panel produced using the metallic partition wall 20 is capable of preventing the metallic partition wall 20 from coming off from the back glass substrate 4 after completion of the manufacturing process.

A generic concept of the display panel according to the embodiment is a display panel including: first and second substrates placed opposite each other to form a hermetically sealed space between them; a resin layer formed on the first substrate; and a metal plate which is covered with an insulating layer, and is fixed to an inner surface of the first substrate with the resin layer, and has a plurality of formed-for-unit-light-emission-area through holes formed in a matrix arrangement in a portion of the metal plate opposite a display area portion of the first substrate for formation of unit light emission areas, and burning-process-use through holes formed in a portion of the metal plate opposite a non-display area portion of the first substrate to function in a burning process.

In the manufacturing process for the display panel build on the generic concept, the metal plate having the formed-for-unit-light-emission-areas through holes and the burning-process-use through holes is placed in a predetermined position on the first substrate having the resin layer formed on its inner surface.

After that, the burning process is performed. Hence, the resin layer formed on the first substrate is fused to the insulating layer covering the metal plate, so that the metal plate is fixed to the predetermined position on the first substrate concerned.

During the burning process, in the display area portion of the first substrate opposite the portion of the metal plate in which the formed-for-unit-light-emission-area through holes are formed, a resin component evaporating from the resin layer formed on the first substrate emanates from the formed-for-unit-light-emission-area through holes. Further, in the non-display area portion of the first substrate opposite the portion of the metal plate in which the burning-process-use through holes are formed, the resin component evaporating from the resin layer emanates from the burning-process-use through holes.

This design allows the resin layer formed on the first substrate of the display panel after the manufacturing process to have approximately equal thickness in the display area portion and the non-display area portion, and therefore the display panel has a negligible gap occurring in the boundary portion between the display area portion and the non-display area portion of the resin layer.

As a result, the display panel built on the generic concept is capable of preventing the metal plate, constituting a partition wall for defining the unit light emission areas, from coming off from the substrate after completion of the manufacturing process.

A generic concept of the method of manufacturing the display panel according to the embodiment includes the steps of: forming a resin layer on an inner surface of a first substrate of first and second substrates which will be arranged opposite each other to form a hermetically sealed space between them; arranging, on the resin layer formed on the first substrate, a metal plate covered with an insulating layer and having a plurality of formed-for-unit-light-emission-area through holes formed in a matrix arrangement in a portion opposite a display area portion of the first substrate for formation of unit light emission areas, and burning-process-use through holes formed in a portion opposite a non-display area portion of the first substrate to function in a burning process; and burning the first substrate having the metal plate arranged thereon to secure the metal plate onto the first substrate by the resin layer.

In the manufacturing method for the display panel build on the generic concept, the resin layer is formed on the inner surface of the first substrate, and then the metal plate having the formed-for-unit-light-emission-areas through holes and the burning-process-use through holes is arranged in a predetermined position on the first substrate.

After that, the burning process is performed. Hence, the resin layer formed on the first substrate is fused to the insulating layer covering the metal plate, so that the metal plate is fixed to the predetermined position on the first substrate.

During the burning process, in the display area portion of the first substrate opposite the portion of the metal plate in which the formed-for-unit-light-emission-area through holes are formed, a resin component evaporating from the resin layer formed on the first substrate emanates from the formed-for-unit-light-emission-area through holes. Further, in the non-display area portion of the first substrate opposite the portion of the metal plate in which the burning-process-use through holes are formed, the resin component evaporating from the resin layer emanates from the burning-process-use through holes.

Accordingly, when the foregoing method is used for manufacturing display panels, the resulting display panel has the resin layer formed on the substrate in approximately equal thickness in the display area portion and the non-display area portion, and therefore has a negligible gap occurring in the boundary portion between the display area portion and the non-display area portion of the resin layer.

As a result, in the display panel manufactured by the method built on the generic concept, it is possible to prevent the metal plate, constituting a partition wall for defining the unit light emission areas, from coming off from the substrate after completion of the manufacturing process.

A generic concept of the partition wall used in the display panel according to the embodiment is a metal-made partition wall which: is placed between first and second substrates to partition a hermetically sealed space, formed between the two substrates, into unit light emission areas; has a plurality of formed-for-unit-light-emission-area through holes formed in a matrix arrangement in a portion of a metal plate opposite a display area portion of the first substrate for formation of the unit light emission areas, and burning-process-use through holes formed in a portion of the metal plate opposite a non-display area portion of the first substrate to function in a burning process; and has an outer surface entirely covered with an insulating layer.

In the manufacturing process for the display panel, the display-panel-use partition wall build on the generic concept is arranged in a predetermined position on the first substrate having the resin layer formed on its inner surface.

After that, the burning process is performed. Hence, the resin layer formed on the first substrate is fused to the insulating layer covering the display-panel-use partition wall, so that the display-panel-use partition wall is fixed to the predetermined position on the first substrate.

During the burning process, in the display area portion of the first substrate opposite the portion of the display-panel-use partition wall in which the formed-for-unit-light-emission-area through holes are formed, a resin component evaporating from the resin layer fused with the display-panel-use partition wall emanates from the formed-for-unit-light-emission-area through holes. Further, in the non-display area portion of the first substrate opposite the portion of the display-panel-use partition wall in which the burning-process-use through holes are formed, the resin component evaporating from the resin layer emanates from the burning-process-use through holes.

Accordingly, in a display panel using the display-panel-use partition wall after the manufacturing process, the resin layer formed on the first substrate of the display panel has approximately equal thickness in the display area portion and the non-display area portion. Thus a gap occurring in the boundary portion between the display area portion and the non-display area portion of the resin layer is negligible.

As a result, once the display-panel-use partition wall built on the generic concept is fixed to the display panel, there may be no occurrence of disjoining between the display-panel-use partition wall and the substrate of the display panel.

The terms and description used herein are set forth by way of illustration only and are not meant as limitations. Those skilled in the art will recognize that numerous variations are possible within the spirit and scope of the invention as defined in the following claims.

What is claimed is:

1. A display panel comprising:

first and second substrates placed opposite each other to form a hermetically sealed space between them;

an electrode protective layer formed on the first substrate; and a metal plate covered with an insulating layer, and fixed onto an inner surface of the first substrate by the electrode protective layer, and having a plurality of formed-for-unit-light-emission-area through holes formed in a matrix arrangement in a portion of the metal plate opposite a display area portion of the first substrate for formation of unit light emission areas, and burning-process-use through holes formed in a portion of the metal plate opposite a non-display area portion of the first substrate to function in a burning process, wherein the metal plate is fixed in the display area portion and the non-display area portion of the first substrate by the electrode protective layer.

2. A display panel according to claim 1, wherein said burning-process-use through holes are formed at regular intervals in the portion of the metal plate opposite the non-display area portion of the first substrate.

3. A display panel according to claim 1, further comprising a registration mark indicated in a selected position on the inner surface of the first substrate, and a registration through hole formed in a portion of the metal plate opposite the registration mark indicated on the first substrate.

4. A display panel according to claim 3, wherein a plurality of said registration marks are respectively indicated in a plurality of positions of the first substrate, and the registration through holes are formed in the metal plate in a number corresponding to the number of registration marks indicated on the first substrate.

5. A method of manufacturing a display panel, comprising the steps of:

forming an electrode protective layer on an inner surface of a first substrate of first and second substrates which are placed opposite each other to form a hermetically sealed space between the two substrates;

arranging, on the electrode protective layer formed on the first substrate, a metal plate covered with an insulating layer and having a plurality of formed-for-unit-light-emission-area through holes formed in a matrix arrangement in a portion opposite a display area portion of the first substrate for formation of unit light emission areas, and burning-process-use through holes formed in a portion opposite a non-display area portion of the first substrate to function in a burning process; and burning the first substrate, having the metal plate arranged thereon, to fix the metal plate onto the first substrate by the electrode protective layer in the display area portion and the non-display area portion of the first substrate.

6. A method of manufacturing a display panel according to claim 5, wherein in the step of arranging the metal plate on the electrode protective layer formed on the first substrate, a position of a registration through hole formed in the metal plate and a position of a registration mark formed in a selected position on the inner surface of the first substrate are aligned with each other for registration of the metal plate with respect to the first substrate.

* * * * *